United States Patent [19]

Kojima

[11] Patent Number: 4,533,015

[45] Date of Patent: Aug. 6, 1985

[54] SOUND ARRESTING DEVICE

[76] Inventor: Hisao Kojima, 3-53-21, Shioiri-cho, Tsurumi-ku, Yokohama-shi, Japan

[21] Appl. No.: 582,714

[22] Filed: Feb. 23, 1984

[30] Foreign Application Priority Data

Feb. 28, 1983 [JP] Japan ..... 58-32040

[51] Int. Cl.[3] ..... F01N 1/10; F01N 1/12

[52] U.S. Cl. ..... 181/280; 181/252; 181/255; 181/256; 181/269

[58] Field of Search ..... 181/252, 256, 279, 280, 181/224, 255

[56] References Cited

U.S. PATENT DOCUMENTS 4,339,918 7/1982 Michikawa ..... 181/280 X

FOREIGN PATENT DOCUMENTS 228315 5/1960 Australia ..... 181/256
807030 12/1936 France ..... 181/280
1149456 12/1957 France ..... 181/280
55-60790 5/1980 Japan .
55-107853 8/1980 Japan .
55-113098 9/1980 Japan .
58-28503 2/1983 Japan .
209884 5/1966 Sweden ..... 181/280

*Primary Examiner*—Benjamin R. Fuller
*Attorney, Agent, or Firm*—Oblon, Fisher, Spivak, McClelland & Maier

[57] ABSTRACT

An element of a sound arresting device has a cylinder and a blade integrally formed in the cylinder and helically twisted along the longitudinal direction of the cylinder. A plurality of elements are coupled to each other along their longitudinal direction and are fitted in a pipe. The ends of the two adjacent blades are perpendicular to each other. The pipe is covered with a sound insulating material. The elements and the pipe are made of a porous metal material, a porous plastic material or a porous ceramic material. When the sound arresting device is used as an automobile muffler, acoustic waves propagating in the gas are repeatedly mixed, interfere with each other and are absorbed by the apertures and the sound insulating material, thereby decreasing noise from the engine. Dust in the exhaust gas is captured by the apertures of the elements and the pipe, and is removed from the exhaust gas.

21 Claims, 18 Drawing Figures

SOUND ARRESTING DEVICE

BACKGROUND OF THE INVENTION

The present invention relates to a sound arresting device for use in a supply/exhaust air duct of a building, an automobile muffler and a rolling stock muffling wall.

In order to deaden noise at its source, it is preferred to surround the source with a sound insulating wall. However, if a power chamber housing an engine or motor is closed, the air flow inside the power chamber will be interrupted. For this reason, it is physically impossible to enclose the noise source in the air duct or the automobile muffler.

For this reason, various types of sound arresting devices have been conventionally proposed to deaden noise while guaranteeing that air will continue to circulate. A sound arresting device of this type is described in Japanese Patent Disclosures No. 55-60790, 55-107853 and 58-28503. Another sound arresting device for deadening noise generated from rolling stock is described in Japanese Patent Disclosure No. 55-113098.

However, the silencing effect of these sound arresting devices is not satisfactory. Their construction is so complex that they are difficult to manufacture.

Additionally, mufflers often contain gas which has a foreign material such as dust (e.g., exhaust gas from a vehicle). The conventional mufflers fail to remove such foreign material from the gas.

SUMMARY OF THE INVENTION

It is an object of the present invention to provide a simple sound arresting device which has a high noise insulating property and which can be easily manufactured.

It is another object of the present invention to provide a sound arresting device capable of removing foreign material such as dust from a gas such as vehicle exhaust gas flowing therethrough.

In order to achieve the above objects of the present invention, there is provided a sound arresting device comprising a passage pipe; and a plurality of blades formed in the passage pipe, the plurality of blades being helically twisted along the longitudinal direction of the passage pipe and being arranged such that ends of two adjacent blades of the plurality of blades cross each other, so that an inner portion of the passage pipe is divided into a plurality of channels through which a gas flows.

When the sound arresting device of the present invention is installed such that the longitudinal direction thereof is directed toward a noise source, an acoustic wave from the noise source helically propagates in one channel in a passage pipe which is partitioned by a blade. This acoustic wave is mixed with another acoustic wave propagating through the other channel. The acoustic wave which linearly propagates through the second channel interferes with the acoustic wave which propagates along the surface of the helical blade, thereby deadening the noise. At a coupling point of adjacent blades, the acoustic waves which propagate through the two different channels interfere with each other to further reduce noise. In this way, the side of the sound arresting device opposite the noise source, has greatly reduced noise. Furthermore, since the gas passes through channels, air flow is not restricted by the sound arresting device.

DETAILED DESCRIPTION OF THE PREFERRED EMBODIMENTS

Figure 1:
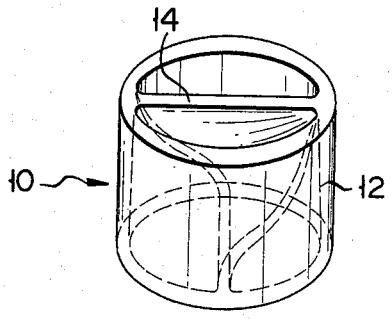
FIGS. 1 to 4, respectively, are perspective views showing elements used in mufflers according to the respective embodiments of the present invention.
Figure 2:
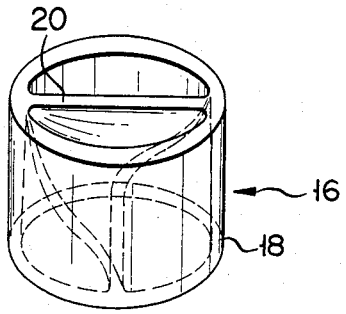
Figure 3:
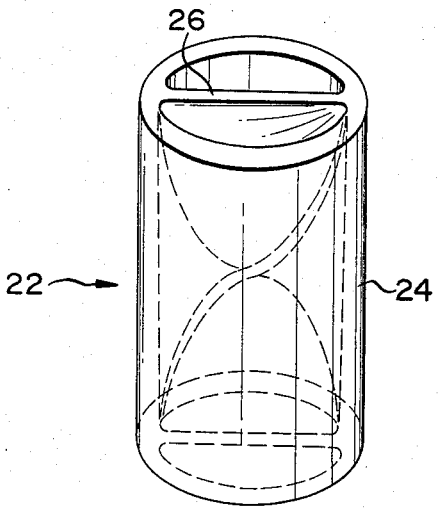
Figure 4:
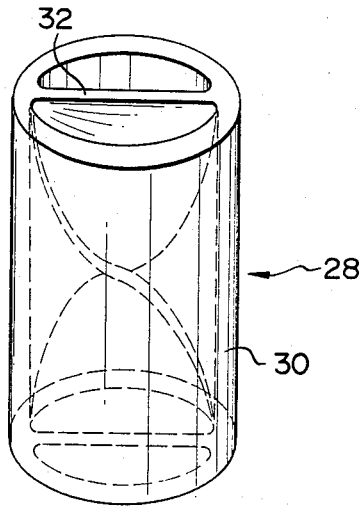

FIGS. 1 to 4, respectively, show elements each of which comprises a blade which is formed integrally with a cylinder. Element 10 in FIG. 1 shows a cylinder 12 and a blade 14 which have been integrally formed. The blade 14 divides the radial section area of the cylinder 12 into halves, and is twisted 90° clockwise along the longitudinal direction of the cylinder 12. Element 16 in FIG. 2 also shows a cylinder 18 and a blade 20 integrally formed. In FIG. 2, element 16 is twisted 90°, but in a counterclockwise direction along the longitudinal direction of the cylinder 18. Element 22 in FIG. 3 has a cylinder 24 and a blade 26 integrally formed, and element 28 shown in FIG. 4 has a cylinder 30 and a blade 32 also integrally formed. The blades 26 and 32 are helically twisted 180° clockwise and counterclockwise along the longitudinal directions of the cylinders 24 and 30, respectively. In any one of these elements 10, 16, 22 and 28, the cylinder is integrally formed with the blade by means of injection molding, extrusion molding or lost wax casting. Each element 10, 16, 22 or 28 can be made a metal such as stainless steel, a plastic, ceramics, or rubber, all of which preferably have porous qualities. A composite material obtained by mixing glass fibers, carbon fibers, metallic fibers, active carbon or a zeolite with any one of the above porous materials may also be used. In addition, a plurality of apertures are formed in the cylinders 12, 18, 24 and 30 of the elements 10, 16, 22 and 28.

Figure 5:
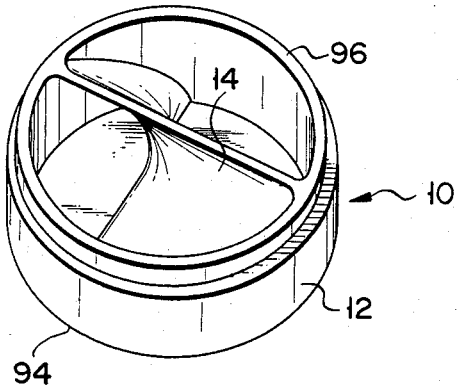
FIG. 5 is an enlarged perspective view of the element shown in FIG. 1.
Figure 6:
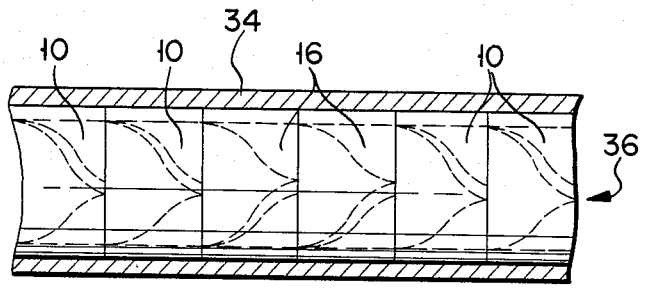
FIGS. 6 to 12, respectively, are side sectional views showing modifications of elements having different arrangments.
Figure 7:
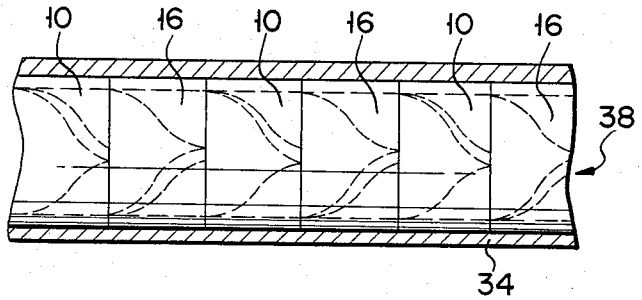
Figure 8:
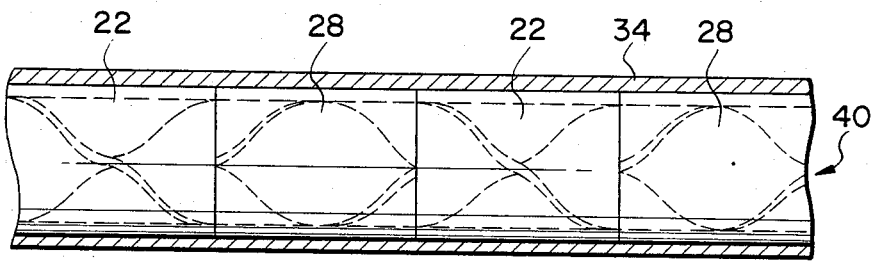
Figure 9:
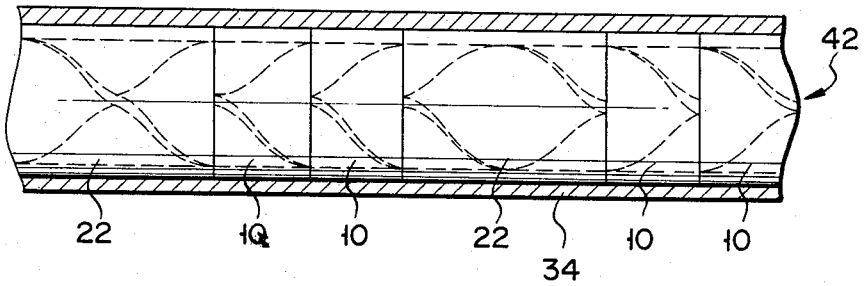
Figure 10:
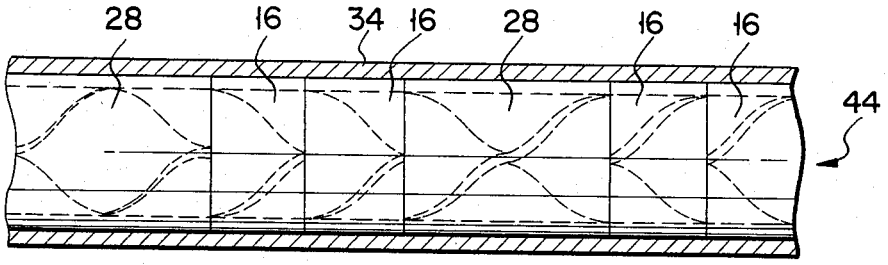

FIG. 5 is an enlarged perspective view of element 10. An outer annular projection 94 is formed at one end of the cylinder 12 of element 10, and an inner annular projection 96 is formed at its other end. When the inner annular projection 96 of one element 10 is fitted in the outer annular projection 94 of another element 10, the two elements can be coupled to each other along their longitudinal direction, thereby constituting a passage tube which has blades. At each coupling point of the adjacent elements, the cylinders may be welded or brazed. Alternatively, as shown in FIG. 6, the elements are fitted and fixed in a pipe 34 which is preferably made of a porous material or formed with a plurality of apertures. Other elements 16, 22 and 28 have outer and inner annular projections in the same manner as the element 10, respectively. Therefore, elements of different types can be coupled along their longitudinal direction to constitute a muffler.

A muffler made of such a combination of elements will be described. FIG. 6 shows a muffler 36 comprising a combination of a plurality of elements 10 and a plurality of elements 16. In this muffler, two elements 10 are first coupled, and two more elements 16 are coupled to one of the two elements 10. These elements 10 and 16 are mounted in the pipe 34. The ends of the blades of adjacent elements are perpendicular to each other. When the muffler 36 is installed such that the longitudinal direction thereof is directed toward the noise source, an acoustic wave from the noise source helically propagating in one channel partitioned by the blades 14 or 20 of the cylinders 12 or 18 is mixed at the element coupling points with an acoustic wave propagating through the other channel. The acoustic wave which linearly propagates through each channel interferes with the acoustic wave which propagates along the surface of the helical blade, thereby deadening the noise. At the coupling point of the elements, the acoustic waves which propagate through different channels interfere with each other, to further reduce noise. At the side opposite the noise source in the muffler 36, noise can be greatly reduced. Furthermore, since gas also passes through the channels, air flow is not restricted by the muffler 36.

Figure 11:
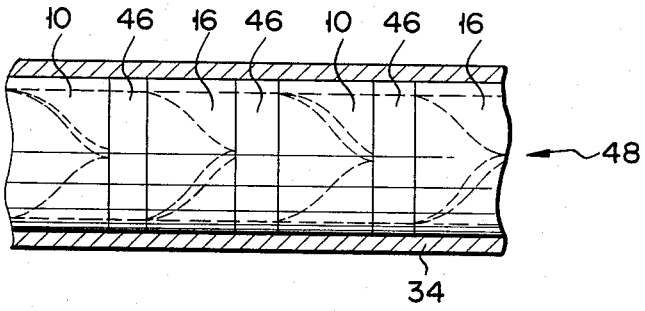
Figure 12:
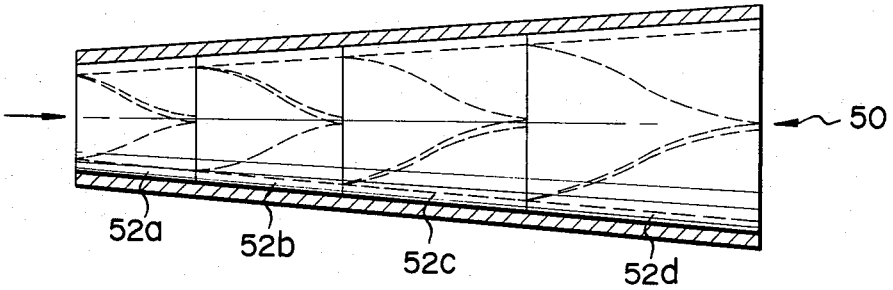

Combinations of elements can be arbitrarily selected. Typical examples are illustrated in FIGS. 7 to 12, respectively. In a muffler 38 of FIG. 7, the elements 10 and the elements 16 are alternately coupled to each other, and the ends of adjacent blades 14 and 20 are perpendicular to each other. In a muffler 40 of FIG. 8, the elements 22 and the elements 28 are alternately coupled to each other, and the ends of adjacent blades 26 and 32 are perpendicular to each other. In a muffler 42 of FIG. 9, sets each having one element 22 and two elements 10 are sequentially coupled to each other so the ends of the blades of adjacent elements are perpendicular to each other. In a muffler 44 of FIG. 10, sets each having one element 28 and two elements 16 are sequentially coupled to each other, so the ends of the blades of adjacent elements are perpendicular to each other. Note that elements having blades twisted clockwise or counterclockwise, respectively, can be coupled together. Furthermore, as shown in FIG. 11, the elements 10 and the elements 16 are alternately coupled through cylindrical spacers 46 each of which has the same diameter as that of the cylinders 12 and 18. Still another modification is shown in FIG. 12, frustum elements 52*a*, 52*b*, 52*c* and 52*d* which increase in size in the order named are coupled to each other along their longitudinal direction to constitute a muffler 50. In this case, the element 52*a* having a smaller sectional area than that of any other element 52*b*, 52*c* or 52*d* is preferably directed toward the noise source.

Figure 13:
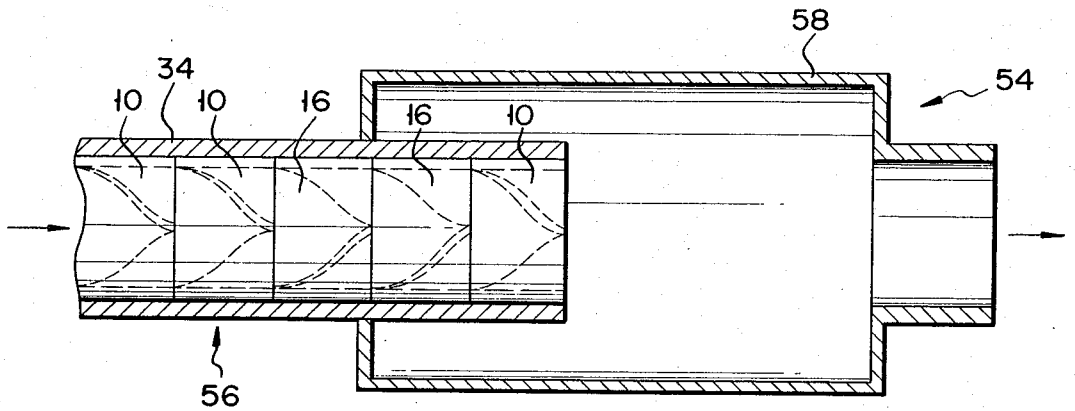
FIGS. 13 and 14, respectively, are side sectional views of mufflers having expansion chambers.
Figure 14:
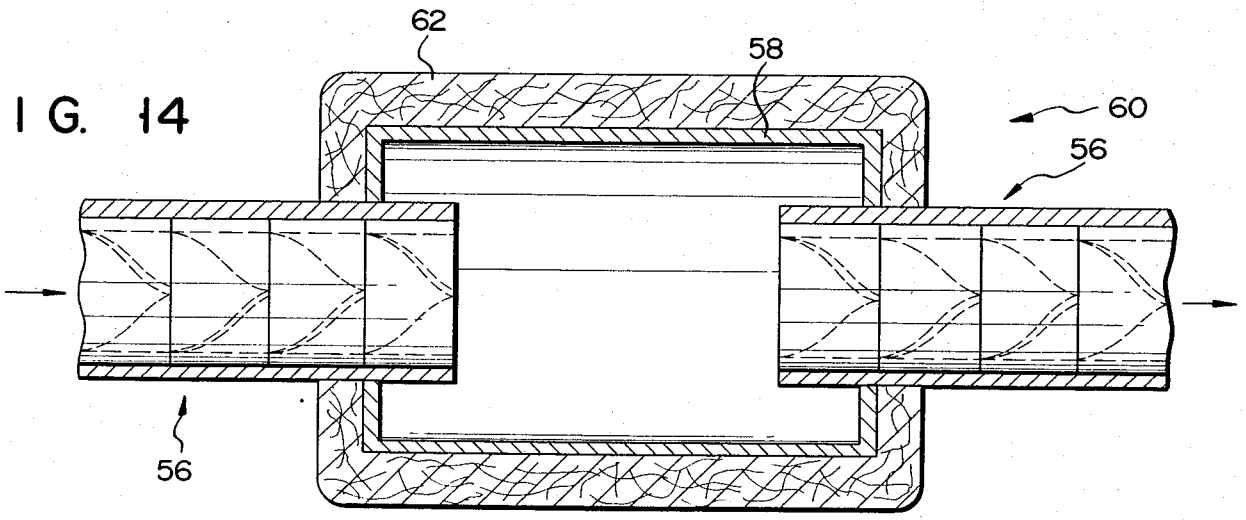

The muffler 54 shown in FIG. 13 has a unit 56 consisting of elements 10 and 16 mounted in a pipe 34, and an expansion chamber 58 coupled to one end of the unit 56, the other end of which is connected to the noise source. Air flows from the noise source to the expansion chamber 58 through the unit 56 along the direction of the arrow to expand in the expansion chamber 58. An acoustic wave propagating together with the air flow is dispersed and resonates in the expansion chamber 58, thus damping noise. In such a case, when the expansion chamber 58 is covered with a sound insulating material 62 as shown in FIG. 14, the muffling effect can be further increased. The expansion chamber 58 is preferably made of a stainless steel plate having a plurality of apertures formed along the direction of its thickness so as to achieve 50% porosity. Therefore, the noise insulating effect is increased by the sound insulating material 62. It is possible to mount another unit 56 at the outlet port of the expansion chamber 58. In the illustrated example, an inlet unit 56 and an outlet unit 56 have the same axis. However, the axis of the inlet unit may be different from that of the outlet unit.

Figure 15:
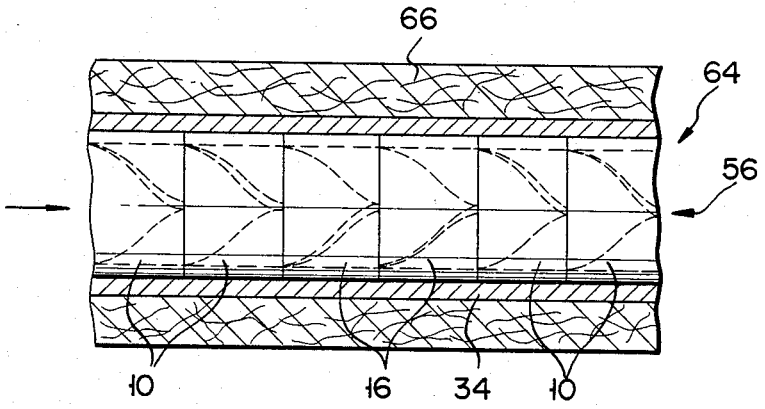
FIGS. 15 to 17, respectively, are side sectional views of mufflers having sound insulating material.

FIG. 15 shows a muffler 64 having a unit 56 which is covered with a sound insulating material 66. The elements 10 and 16 and the pipe 34 which constitute the unit 56 are preferably made of a porous material to further increase the muffling effect. Dust is contained in the exhaust gas of a vehicle. When the muffler 64 shown in FIG. 15 is used as an automobile muffler, the unit 56 is preferably made of a porous material since the exhaust gas flowing in the direction of the arrow in FIG. 15 is captured at the apertures of the baffles, cylinders or pipe. The unit 56 made of a porous material provides a noise insulating effect and also a filtering effect for removing particles such as dust or the like.

A muffler 64 may be constructed without using the pipe 34 such that the annular projections 94 and 96 of adjacent elements 10 and 16 are fitted with each other. An assembly of the elements 10 and 16 may be directly covered with the sound insulating material 66. Since resistance decreases when gas flows through sound insulating material 66, the pressure at an inlet port of the muffler 64 also decreases. As a result, a load on an engine or the like can be decreased.

The elements 10 and 16 may be disposed such that those elements 10 and 16 located near the inlet port of the muffler 64 have pores or apertures which are larger than those of elements located near the outlet port. In this case, large dust particles can be removed by the elements at the inlet port side of the muffler, and small dust particles can be removed by the elements at the outlet port side. Similarly, a coarse sound insulating material may be used at the inlet port side of the muffler, and a fine sound insulating material may be used at the outlet port side.

The muffler 64 is preferably provided with a heating means for heating at least one type of member such as the cylinders 12 and 18 of the elements 10 and 16, their blades 14 and 20, and the sound insulating material 66. For example, dust contained in automobile exhaust gas contains free carbon as a result of incomplete combustion by the engine. When the blades or the like are heated to combust carbon to produce carbon dioxide gas, such carbon particles disappear. Therefore, dust will not be deposited on the blades or the like, and the filtering effect of the muffler 64 is maintained. The heating means comprises a resistor heater disposed around the sound insulating material 66. When the resistor heater is energized, the muffler 64 is heated. Alternatively, the heating means may comprise a burner disposed in the vicinity of the muffler 64. Furthermore, the elements may be made of a conductive ceramic material which is energized to generate heat; with such a heating means, an additional member such as a heater or burner need not be provided to generate heat.

Figure 16:
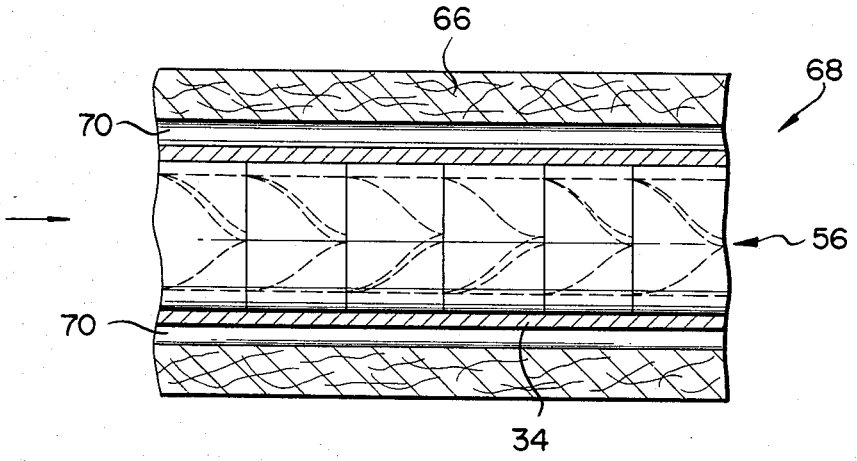
Figure 17:
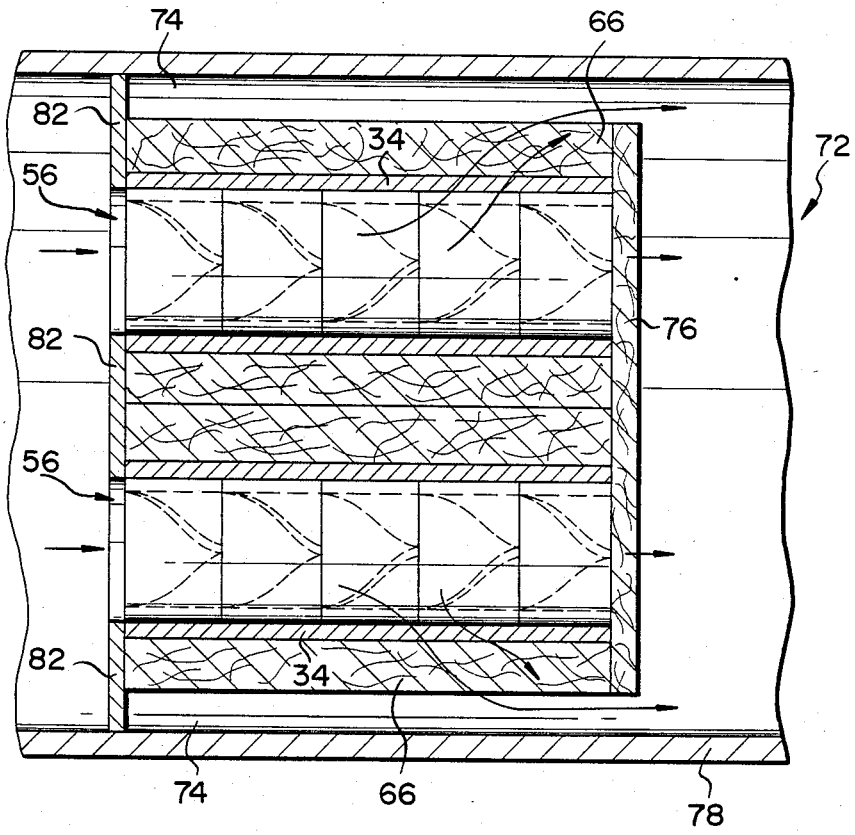

A muffler 68 shown in FIG. 16 has a cylindrical space 70 formed between a unit 56 and a sound insulating material 66. The pipe 34 is made of a porous material or has a plurality of apertures in the direction of its thickness. Some of the dust passing through the unit 56 passes through the pipe 34 and collects in the space 70. The muffler 72 shown in FIG. 17 has a cylindrical housing 78 which contains a pair of units 56 which are parallel. Each unit 56 is covered with the sound insulating material 66. A space 74 is formed between the sound insulating material 66 and the housing 78. The exhaust gas flows in the direction indicated by the arrows. A foamed member 76 made of a foamed metal with a porosity of about 95% is disposed at the outlet ports of the units 56. Shielding plates 82 are disposed at the inlet ports of the elements to prevent exhaust gas from entering into any portion other than the elements. Some of the gas flowing through the units 56 passes through the pipe 34 and flows into the space 74. This portion of the gas flows to the outlet port side through the space 74, and the remaining portion of the gas flows through the foamed member 76 toward the outlet port. In this manner, the gas flows through the pipe 34, the sound insulating material 66 and the foamed member 76 toward the outlet port so that any sound propagating in the gas can be decreased and the dust in the gas can be filtered. Since the foamed member 76 has a porosity of about 95%, a large resistance will not be applied to the gas flowing therethrough. As a result, the pressure at the inlet port side of the muffler 72 will not decrease. The foamed member 76 may also be mounted at the outlet port of the muffler 68 as shown in FIG. 16.

Figure 18:
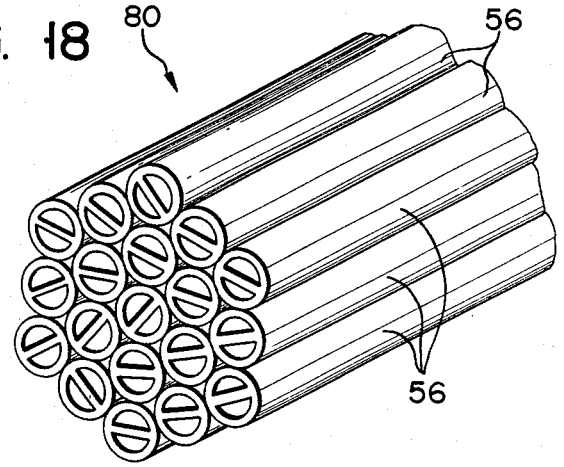
FIG. 18 is a partial perspective view showing a sound arresting device applied to a sound insulating wall.

When a muffler having the construction described above is used as an automobile muffler, a unit is disposed in the middle or rear end of the muffler through which the exhaust gas flows. In this case, when each element is made of a metal having a catalytic property, nitrogen oxide ($NO_x$) can be removed from the exhaust gas while the exhaust gas flows through the unit. On the other hand, when a muffler 80 is to be mounted on a wall of a power chamber or a noise insulating wall, a plurality of units 56 are bundled together, as shown in FIG. 18. In this construction, a chamber wall or a noise insulating wall providing a noise insulating effect and a vent effect is obtained. In this case, the spaces between the units 56 may be filled with sound insulating material or an adhesive. By preparing molds which constitute the shape of the bundled elements 10, a sheet-like noise insulating wall shown in FIG. 18 can be cast. In this case, split molds consisting of male and female molds can be used. The spaces between the elements 10 can be filled with a constituent material (e.g., plastic).

According to the present invention as described in detail above, a muffler having a high noise insulating property is easily manufactured. The diameter and length of the element and the angle of twist of the blade can be arbitrarily determined in accordance with the type of noise source. In the above embodiments and modifications, the inner area of each element is divided into two parts. However, the inner area can also be divided into three parts. In this case, the blade is twisted through 60° or 120° along the longitudinal direction of the corresponding cylinder, thereby further improving the silencing effect. In the above embodiments, the blade is integrally formed with the cylinder. However, they may be separately formed. In this case, the blade is inserted in the cylinder and is fixed at both ends to the cylinder. The element may also be manufactured so as to comprise a ring portion having a ring member and a radial portion extending through a center of the ring member. The ring portions overlap such that the radial portions thereof are slightly offset from each other.

What is claimed is:

1. A sound arresting device comprising a plurality of longitudinally coupled elements, each of the elements including a cylinder having an axis extending in a longitudinal direction and coupled to an adjacent cylinder of another element spaced therefrom along said longitudinal direction, and a blade formed in said cylinder so as to be integral therewith, each said blade being helically twisted along said longitudinal direction of said cylinder and being arranged such that each end of each said blade crosses an adjacent end of an adjacent blade, so that an inner portion of said cylinder is divided into plurality of channels through each of which a gas flows.

2. The sound arresting device of claim 1 wherein said elements have blades which are clockwise helically twisted and blades which are counterclockwise helically twisted, said elements being arranged alternately so that facing end edges of the blades cross each other.

3. A sound arresting device according to claim 1, wherein the each element includes an outer annular projection formed at one end face of the cylinder and an inner annular projection formed at the other end face thereof, the inner annular projection being fitted in the outer annular projection to couple two adjacent cylinders of the plurality of elements.

4. A sound arresting device according to claim 3, further comprising a pipe into which the each element is inserted.

5. A sound arresting device according to claim 4, further comprising a cylindrical spacer disposed between two adjacent elements.

6. A sound arresting device according to claim 3, wherein there is provided a unit consisting of a plurality of the elements, and the sound arresting device has a sound insulating material which covers the unit.

7. A sound arresting device according to claim 6, wherein each said element is made of a porous material.

8. A sound arresting device according to claim 7, wherein the unit has a pipe into which the elements are inserted, and the pipe is made of a porous material.

9. A sound arresting device according to claim 8, wherein the each element and the pipe are made of a material selected from the group consisting of a porous metal material, a porous plastic material and a porous ceramic material.

10. A sound arresting device according to claim 9, wherein the each element and the pipe are made of a composite material obtained by adding one from a group consisting of a glass fiber, a carbon fiber, a metallic fiber, active carbon and a zeolite to one of the porous metal material, the porous plastic material and the porous ceramic material.

11. A sound arresting device according to claim 8, wherein the sound arresting device has a space formed between the pipe and the sound insulating material, the gas passing through the space.

12. A sound arresting device according to claim 8, wherein the unit has an outlet port through which the gas flows out, and the sound arresting device has a foamed member made of a foamed material and disposed at the outlet port of the unit, the gas passing through the foamed member.

13. A sound arresting device according to claim 12, wherein the sound arresting device has a pair of units disposed to be parallel to each other and perpendicular to the longitudinal direction of the units.

14. A sound arresting device according to claim 6, wherein a cylinder of each element has a plurality of apertures in a direction of a thickness thereof.

15. A sound arresting device according to claim 14, wherein the unit has a pipe into which the elements are inserted and the pipe has a plurality of apertures in a direction of a thickness thereof, the pipe being covered with a sound insulating material.

16. A sound arresting device according to claim 1, wherein each cylinder has a frustum shape which increases in size along the longitudinal direction thereof.

17. A sound arresting device according to claim 1, wherein the passage pipe has an outlet port through which a gas flows out, and the sound arresting device has an expansion chamber coupled to the outlet port of the passage pipe, the gas flowing through the passage pipe being expanded as exhausted from the outlet port into the expansion chamber.

18. A sound arresting device according to claim 17, wherein the sound arresting device has a sound insulating material which covers the expansion chamber.

19. A sound arresting device according to claim 1, wherein there is provided a unit consisting of a plurality of the elements coupled to each other, and the sound arresting device has a plurality of the units bundled together to constitute a wall.

20. A sound arresting device according to claim 1, wherein the blade of the each element is twisted 90° along the longitudinal direction of the cylinder.

21. A sound arresting device according to claim 1, wherein the blade of the each element is twisted 180° along the longitudinal direction of the cylinder.

* * * * *